US009297106B2

(12) United States Patent
Doh

(10) Patent No.: US 9,297,106 B2
(45) Date of Patent: Mar. 29, 2016

(54) WASHING MACHINE HAVING A DETERGENT BOX WITH A PARTITIONING MEMBER

(75) Inventor: Young Jin Doh, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1321 days.

(21) Appl. No.: 13/129,675

(22) PCT Filed: Nov. 17, 2009

(86) PCT No.: PCT/KR2009/006747

§ 371 (c)(1),
(2), (4) Date: Oct. 11, 2011

(87) PCT Pub. No.: WO2010/056085

PCT Pub. Date: May 20, 2010

(65) Prior Publication Data

US 2012/0017653 A1 Jan. 26, 2012

(30) Foreign Application Priority Data

Nov. 17, 2008 (KR) ..... 10-2008-0114171
Nov. 17, 2008 (KR) ..... 10-2008-0114177
Nov. 17, 2008 (KR) ..... 10-2008-0114178

(51) Int. Cl.
*D06F 39/02* (2006.01)

(52) U.S. Cl.
CPC ..... *D06F 39/02* (2013.01); *D06F 39/022* (2013.01)

(58) Field of Classification Search
CPC ..... D06F 39/02
See application file for complete search history.

(56) References Cited

U.S. PATENT DOCUMENTS 4,759,202 A 7/1988 Caron ..... 68/17
2005/0274155 A1* 12/2005 Namkung et al. ..... 68/17 R

FOREIGN PATENT DOCUMENTS

| | | | |
|---|---|---|---|
| CN | 200947315 | Y | 9/2007 |
| CN | 101168913 | A | 4/2008 |
| EP | 1 607 508 | A2 | 12/2005 |
| GB | 2 187 763 | A | 9/1987 |
| KR | 10-2005-0045258 | | 5/2005 |
| KR | 10-2005-0118617 | | 12/2005 |
| KR | 10-2005-0118618 | | 12/2005 |
| KR | 10-2005-0119076 | | 12/2005 |

OTHER PUBLICATIONS

Chinese Office Action dated Aug. 28, 2012 issued in Application No. 20098010154660.2 (with English Translation).

(Continued)

*Primary Examiner* — Michael Barr
*Assistant Examiner* — Spencer Bell
(74) *Attorney, Agent, or Firm* — Ked & Associates, LLP

(57) ABSTRACT

The present invention relates to a washing machine. More specifically, the invention relates to a washing machine comprising: a detergent box which is provided in a withdrawable fashion on the water-supply flow pathway of the washing machine, and which is formed with a detergent-holding unit in such a way that it can hold detergent; and a portioning member which closes the detergent-holding unit when a liquid detergent is being introduced into the detergent-holding unit, and which opens the detergent-holding unit when a powdered detergent is being introduced into the detergent-holding unit.

4 Claims, 10 Drawing Sheets

(56) References Cited

OTHER PUBLICATIONS

International Search Report issued in PCT Application No. PCT/KR2009/006747 dated Jul. 9, 2010.

European Search Report dated Oct. 18, 2013 issued in Application No. 09 82 6317.

* cited by examiner

WASHING MACHINE HAVING A DETERGENT BOX WITH A PARTITIONING MEMBER

CROSS-REFERENCE TO RELATED PATENT APPLICATIONS

This application is a U.S. National Stage Application under 35 U.S.C. §371 of PCT Application No. PCT/KR2009/006747, filed Nov. 17, 2009, which claims priority to Korean Patent Application Nos. 10-2008-0114171, 10-2008-0114177, 10-2008-0114178, all filed Nov. 17, 2008.

BACKGROUND OF THE INVENTION

1. Field of the Invention

The present invention relates to a washing machine equipped with a detergent box having a structure which is used in order to introduce both powered detergents and liquid detergents. More specifically, the present invention relates to a washing machine which allows a user not only to supply powdered detergent mainly used conventionally but also to supply liquid detergent by the simple operation of folding or unfolding an opening and closing partition of the detergent box without installing a separate auxiliary receiving platform for liquid detergent inside the detergent box when the user attempts to use the liquid detergents.

2. Description of the Related Art

A washing machine is an apparatus for cleaning laundry via washing, rinsing, and dewatering in order to separate dirt from the laundry such as clothes or bedding by using water, detergent and mechanical rotation. The laundry is washed as a washing tub containing the water, detergent, and laundry is rotated by a driving mechanism inside the washing machine.

Inside the washing machine, disposed are a water supply mechanism supplying water to a washing tub, a drainage mechanism draining water inside the washing tub to the outside, and a detergent supply mechanism on a water-supply flow pathway of the water supply mechanism supplying detergents to the inside of the washing tub.

The detergent supply mechanism includes a dispenser connected to the water-supply flow pathway and a detergent box (drawer) for containing various types of detergents, the detergent box being disposed in such a way that the detergent box can be loaded or unloaded to and from the dispenser.

A conventional detergent box has been designed to use powdered detergents; therefore, in order to use liquid detergents, an auxiliary receiving platform in the shape of a cup to receive liquid detergents has to be installed additionally within the detergent box.

In other words, in a partition structure of the detergent box, due to the inherent characteristics of granular and liquid materials, the powdered detergents should be used in an open structure which allows dissolving of powdered detergents in the detergent box while being mixed with water. On the other hand, liquid detergents should be used in an enclosed structure securing the liquid detergents inside the detergent box to prevent leaking before actually being put into the washing tub. Therefore, conventional detergent boxes intended for powdered detergents cannot accommodate a structure allowing both liquid and powdered detergents appropriate for such contradictory detergent holding environments. Due to this reason, an auxiliary receiving platform for putting liquid detergents should be installed additionally to the detergent box in order to use liquid detergents.

SUMMARY OF THE INVENTION

Technical Problem

In a conventional detergent box used only for powdered detergents, the invention has been made in an effort to provide a detergent box allowing the user to introduce liquid or powdered detergent by applying a simple physical operation against an internal structure of the detergent box without installing an additional auxiliary receiving platform for liquid detergents inside the detergent box. By doing so, the invention attempts to provide a washing machine equipped with a detergent box providing convenience for the user to freely use both liquid and powdered detergents without being limited by physical characteristics of employed detergents.

In addition, the invention has been made in an effort to provide a washing machine receiving either liquid or powdered detergents in a detergent-holding unit.

Technical Solution

The present invention provides a washing machine including: a detergent box which is provided in a withdrawable fashion on the water-supply flow pathway of the washing machine, and which is formed with a detergent-holding unit in such a way that it can hold detergent; and a portioning member which closes the detergent-holding unit when a liquid detergent is being introduced into the detergent-holding unit, and which opens the detergent-holding unit when a powdered detergent is being introduced into the detergent-holding unit.

A washing machine of the present invention uses a partition structure for containing various types of detergents separately in a detergent box, where an upper fixed partition and a lower, rotatable opening and closing partition fastened to a lower end of the upper partition are formed separately. The detergent box of the invention, according to the characteristics of powdered or liquid detergents, allows the user to selectively perform the simple operation of opening a lower part of the partition by folding the lower opening and closing partition in an upward direction; or closing the lower part of the partition by unfolding the folded lower opening and closing partition in a downward direction. By doing so, the detergent box of the invention can contain not only powdered detergent mainly used conventionally when the partition is partially opened, but also contain and use liquid detergent without installing a separate auxiliary receiving platform for liquid detergents inside the detergent box when the partition is fully closed. Therefore, by using only such a simple modification of a partition, the user can conveniently use both powdered and liquid detergents.

Also, the washing machine of the present invention closes a detergent flow hole by fastening a partitioning member to a guide. If the detergent flow hole is closed, liquid detergents can be stored in the detergent-holding unit. Therefore, the user can use the liquid detergents without storing the liquid detergents in a separate container. Also, since the user can easily fasten the partitioning member to the guide, user convenience is improved.

DETAILED DESCRIPTION OF THE INVENTION

In what follows, a washing machine according to preferred embodiments of the present invention will be described in detail with reference to the appended drawings.

Figure 1:
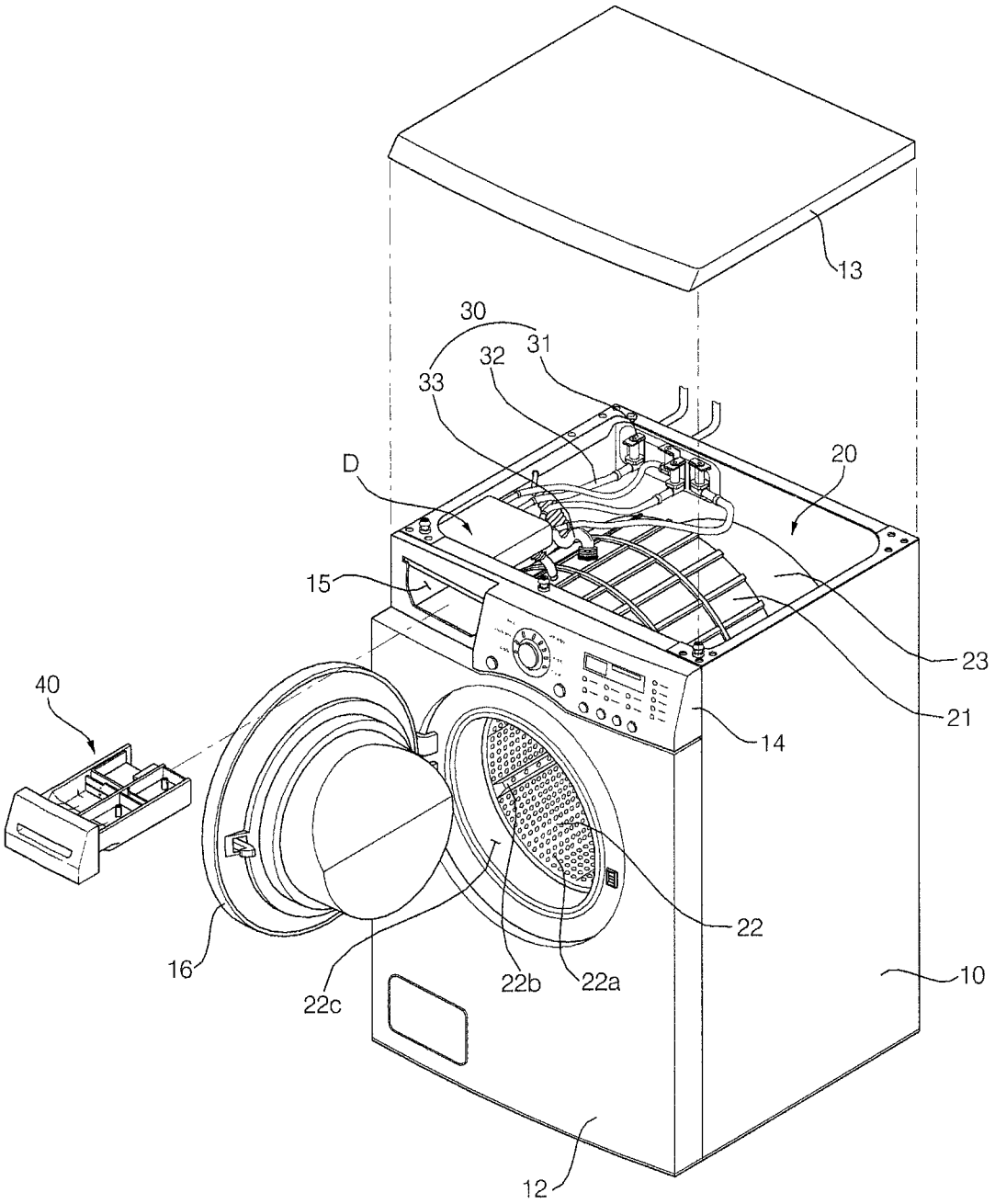
FIG. 1 is an exploded perspective view illustrating a structure of a detergent supply mechanism of a washing machine according to one embodiment of the present invention by opening a top plate.
Figure 2:
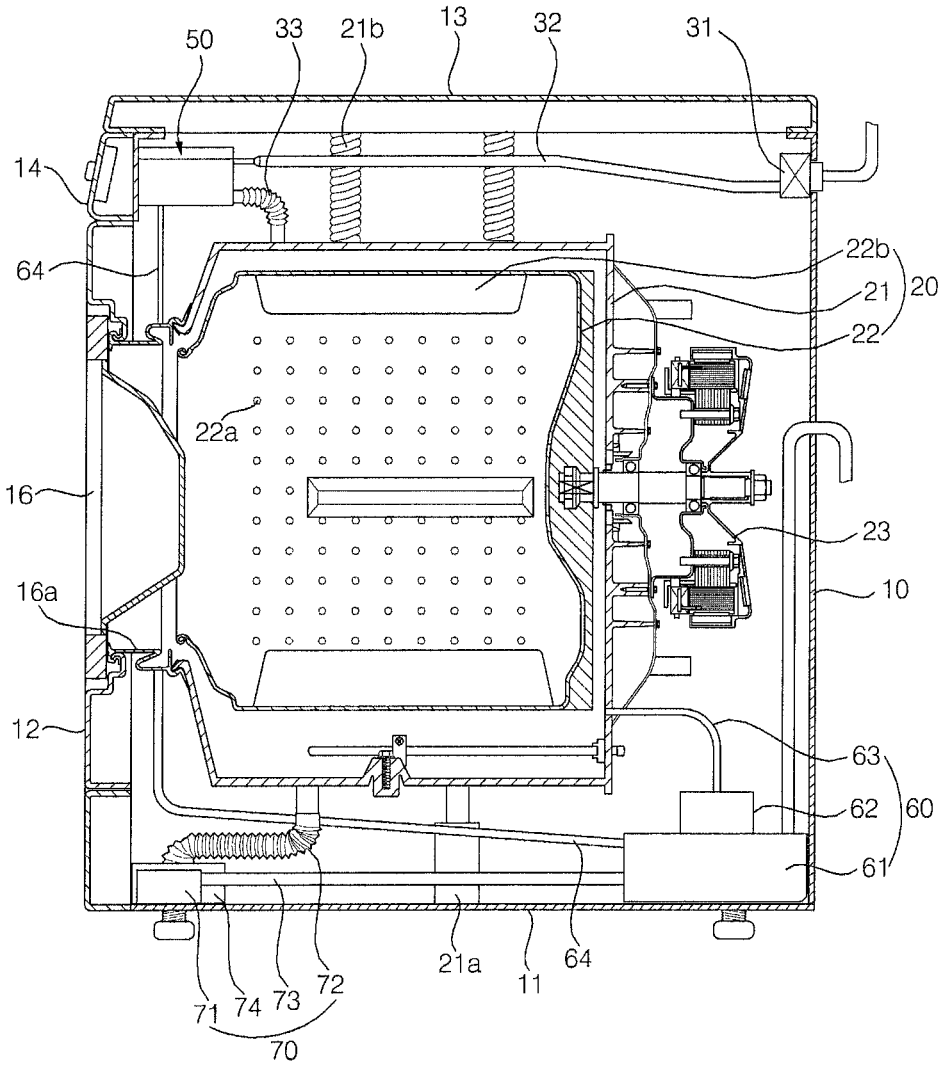
FIG. 2 is a longitudinal side sectional view illustrating the internal structure of the washing machine of FIG. 1.
Figure 3:
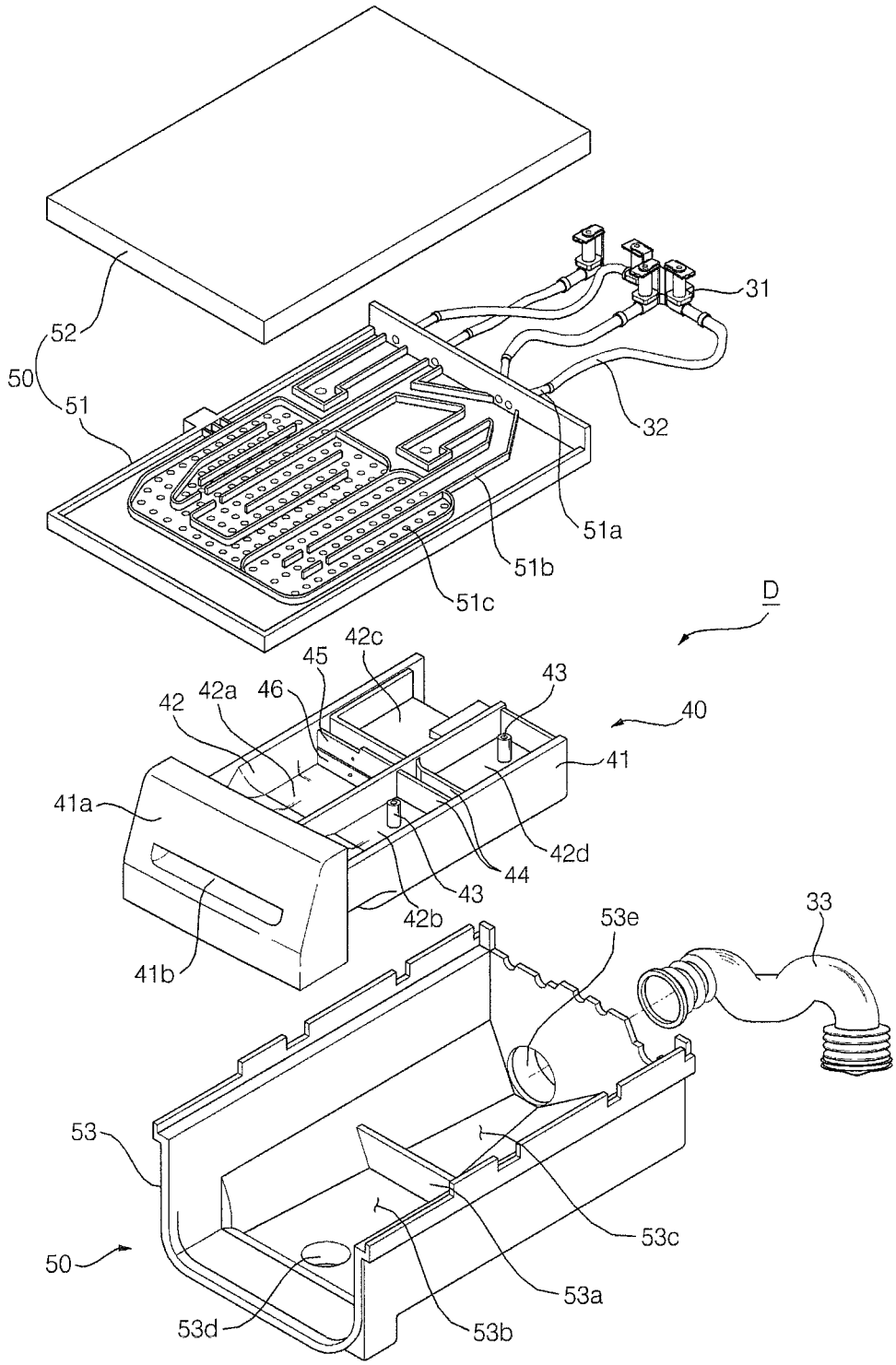
FIG. 3 is an exploded perspective view illustrating a detailed structure of a detergent supply mechanism applied to the washing machine of FIG. 1.
Figure 4:
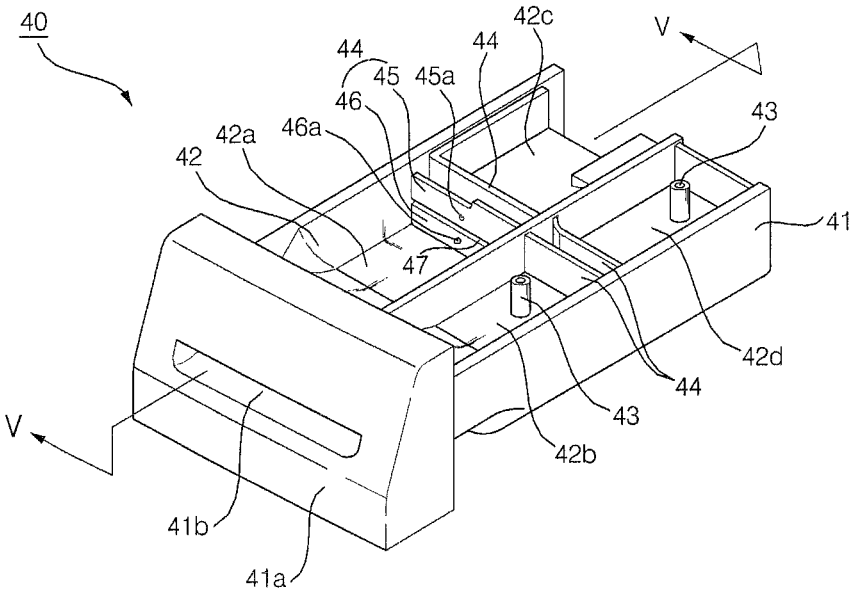
FIG. 4 is a perspective view of a structure of a detergent box applied to the washing machine of the present invention.
Figure 5:
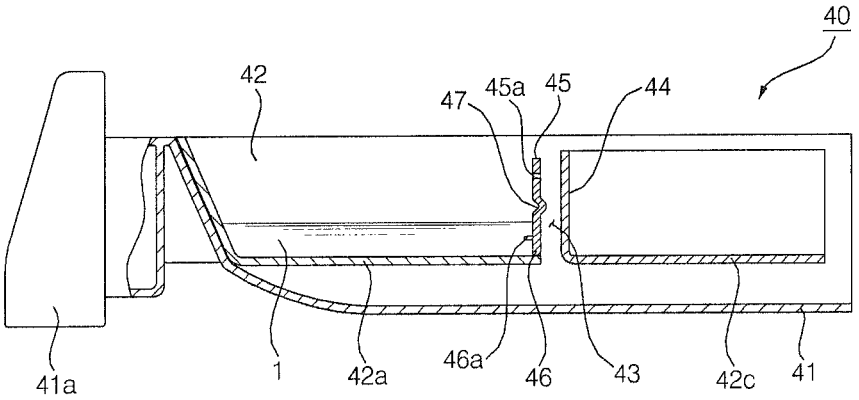
FIG. 5 is a schematic cross-sectional view of FIG. 4 along V-V line illustrating an internal state when liquid detergents are introduced into a detergent box of the present invention.
Figure 6:
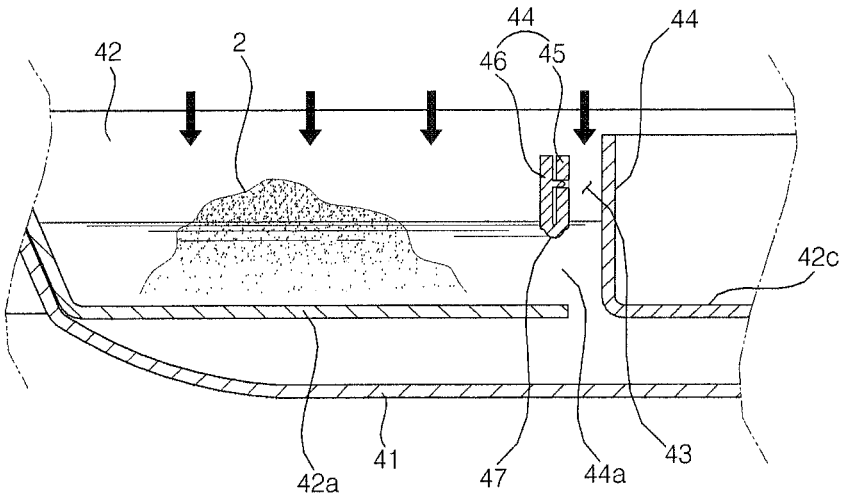
FIG. 6 is a magnified cross-sectional view illustrating an internal state of a partial area when powdered detergents are put inside a detergent box of the present invention.
Figure 7:
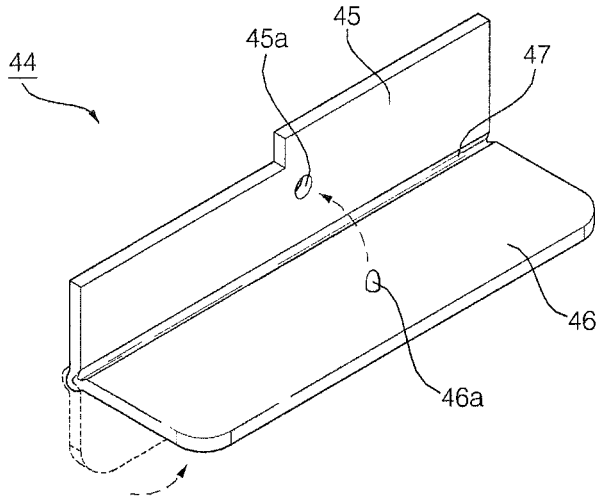
FIG. 7 is a perspective view of one embodiment of a partition applied to a detergent box of the present invention.
Figure 8:
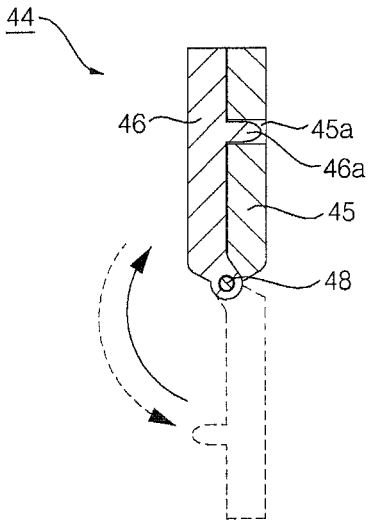
FIG. 8 is a schematic longitudinal view showing another embodiment of a partition applied to a detergent box of the present invention.

FIG. 1 is an exploded perspective view illustrating a structure of a detergent supply mechanism D of a washing machine according to one embodiment of the present invention by opening a top plate 13; FIG. 2 is a longitudinal side sectional view illustrating the internal structure of the washing machine of FIG. 1; FIG. 3 is an exploded perspective view illustrating a detailed structure of a detergent supply mechanism D applied to the washing machine of FIG. 1; FIG. 4 is a perspective view of a structure of a detergent box 40 applied to the washing machine of the present invention; FIG. 5 is a schematic cross-sectional view of FIG. 4 along V-V line illustrating an internal state when liquid detergents 1 are put inside a detergent box 40 of the present invention; FIG. 6 is a magnified cross-sectional view illustrating an internal state of a partial area when powdered detergents 2 are put inside a detergent box 40 of the present invention; FIG. 7 is a perspective view of one embodiment of a partitioning member 44 applied to a detergent box 40 of the present invention; and FIG. 8 is a schematic longitudinal view showing another embodiment of a partitioning member 44 applied to a detergent box 44 of the present invention.

First, with reference to FIGS. 1 and 2, the overall structure of a (drum-type) washing machine according to one embodiment of the present invention will be described.

A washing machine according to the present invention includes a cabinet 10 forming an external appearance; a washing tub 20 being disposed in a rotatable manner inside the cabinet 19 and receiving laundry, detergents, and water; a driving mechanism 23 being connected to the washing tub 20 and driving the washing tub 20; a water supply mechanism 30 supplying water to the washing tub 20; a detergent supply mechanism D receiving water supplied from the water supply mechanism 30 and detergents introduced by the user, mixing them, and providing the mixture to the washing tub 20; and a drainage mechanism 70 draining water contaminated after washing to the outside from the washing tub 20.

A base plate 11 is disposed in a lower part of the cabinet 10; a top plate 13 in an upper part thereof; and a front cover 12 having a control panel 14 for operation of the washing machine on the front surface thereof, altogether forming an external appearance in the shape of a conventional square box.

In the central part of the front cover 12, a laundry entrance hole 22*c* for loading or unloading laundry to and from the washing tub 20 is formed; and an opening and closing door 16 is installed thereto. Along the periphery of the laundry entrance hole 22*c*, a gasket 16*a* is installed for sealing when the door 16 is closed.

Conventionally, in one upper side of the front cover 12, formed is detergent box receiving space 15 for loading and unloading the detergent box 40 to and from the washing machine.

The washing tub 20 includes a tub 21 supported by a damper 21*a* and springs 21*b* in such a way to be installed in a shock-absorbing state inside the cabinet 10 and receiving laundry therein, a drum 22 concentrically superimposed on the tub 21 so as to be rotatable within the tub 21 to contain water and detergents therein, and having a plurality of water holes 22*a* through which the water and detergents inside the tub 21 pass; and a lifter 22*b* being disposed in the inner surface of the drum 22 and lifting up the laundry up to a predetermined height when the drum 22 is rotated and dropping down the laundry.

The water supply 30 includes a plurality of water supply control valves 31 disposed in the cabinet 10 and connected to an external water source; and a water-supply flow pathway formed between the water supply control valves 31 and the tub 21 to guide water into the tub 21. The water-supply flow pathway includes a plurality of incoming water supply pipes 32 connecting the water supply control valves 31 and the detergent supply mechanism D to each other; and an outgoing water supply pipe 33 connecting the detergent supply D and the tub 21.

Conventionally, the water supply control valve 31 is installed in such a way to penetrate an upper part of a rear surface of the cabinet 10, the water supply control valves 31 including a plurality of hot water supply control valves to let in hot water and a plurality of cold water supply control valves to let in cold water.

Between the incoming water supply pipes 32 and the outgoing water supply pipe 33, the detergent supply mechanism D is connected so that detergents can be supplied to the tub 21 together with water supplied through the water supply mechanism 30. In other words, the incoming water supply pipes 32 are installed between the water supply control valves 31 and the detergent supply mechanism D to guide water to the detergent supply mechanism D; a plurality of hot water pipes are disposed between the respective hot water supply control valves and the detergent supply mechanism D while a plurality of cold water pipes are disposed between the respective cold water supply control valves and the detergent supply mechanism D.

The drainage mechanism 70 includes a draining pump 71 providing draining power; a draining guide pipe 72 being connected to a lower part of the tub 21 and collecting and guiding washing water used for washing and rinsing by using the power of the draining pump 71; a draining pipe 73 draining the washing water to the outside; and a draining filter 74 being installed on the draining pipe 73 and filtering residue from washing.

As shown in FIG. 2, the washing machine according to the present invention may further include a separate liquid detergent supply mechanism 60 as means for getting rid of the inconvenience of putting detergent into the detergent box 40 for each washing cycle. That is, the liquid detergent supply mechanism 60 is adapted in such a way that a large amount of detergent is introduced into the detergent box 40 to store a sufficient amount of detergent in a liquid state in a separate liquid detergent storage unit 61 and a fixed amount of detergent is automatically supplied from the liquid detergent storage unit 61 at each laundry cycle. The liquid detergent supply mechanism 60 includes the liquid detergent storage unit 61 for storing at least one liquid detergent supplied to the tub 21 and a liquid detergent supply mechanism 60 for automatically supplying the liquid detergent stored in the liquid detergent storage unit 61 into the tub 21.

The liquid detergent supply mechanism 60 includes a liquid detergent supply pump 62 providing power to supply a liquid detergent into the tub 21, a liquid detergent supply pipe 63 connecting between the liquid detergent storage unit 61 and the tub 21, and a liquid detergent supply connection pipe 64 connecting between the detergent box 40 and the liquid detergent storage unit 61.

Of course, the liquid detergent supply mechanism 60 may have other various configurations. In one example, the liquid detergent supply pipe 63 may be directly connected to the water supply mechanism 30.

By further including the liquid detergent supply mechanism 60 including a separate liquid detergent storage unit 61 as above, the liquid detergent storage unit 61 is connected to the detergent box 40 by the liquid detergent supply connection pipe 64 to allow a liquid detergent to be additionally stored inside the liquid detergent storage unit 61.

As shown in FIGS. 1 to 4, the detergent supply mechanism D includes a dispenser 50 to which the incoming water supply pipes 32 and the outgoing water supply pipe 33 are connected and a detergent box 40 disposed inside the dispenser 50 to be drawn in and out forward and backward and having a detergent-holding unit 42 partitioned off into a plurality of compartments 42*a*, 42*b*, 42*c*, and 42*d* for separately holding at least one detergent.

As shown in FIG. 3. The dispenser 50 includes a dispenser housing 53, which is installed in the detergent box receiving space 15 of the cabinet 10 (see FIG. 1) and whose front and top are open, a cover for covering the open top of the dispenser housing 53, and a dispenser body 51 mounted in the dispenser housing 53 and the cover 52 and spraying water coming from the incoming water supply pipes 32 to the detergent-holding unit 42 of the detergent box 40.

The dispenser housing 53 has a plurality of space portions 53*b* and 53*c* divided into front and rear areas by a partition 53*a* crossing the interior thereof. A liquid detergent supply opening 53*d* communicating with the liquid detergent supply connection pipe 64 penetrates the front space portion 53*b*, and a liquid detergent discharge opening 53*e* communicating with the outgoing water supply pipe 33 penetrates the rear space portion 53*c*.

The dispenser body 51 is enclosed with the cover 52 to form a branch flow path 51*b*, is provided on the rear surface with a plurality of pipe connecting portions 51*a* connected to ends of the incoming water supply pipes 32, and has a plurality of nozzles 51*c* formed at the corresponding positions so as to spray water to the respective compartments 42*a*, 42*b*, 42*c*, and 42*d* of the detergent box 40.

As shown in FIGS. 3 and 4, the detergent box 40 is received within the dispenser housing 53 and disposed below the dispenser body 51. The detergent box 40 includes a detergent box body 41 forming the detergent-holding unit 42 and a front cover 41*a* formed on the front surface of the detergent box body 41. The front cover 41*a* has a hand grip 41*b* that allows the user to withdraw the detergent box body 41 and put detergent therein.

The detergent-holding unit 42 may have a structure for holding both liquid detergent 1 and powdered detergent 2. For example, as shown in FIG. 4, the detergent-holding unit 42 may be partitioned off into four compartments 42*a*, 42*b*, 42*c*, and 42*d* to separately hold a liquid detergent 1 in one compartment 42*a*, a powdered detergent 2 in another compartment 42*b*, a bleaching agent in still another compartment 42*c*, and a fabric softener in the remaining compartment 42*d*. Usually, an auxiliary receiving platform (not shown) is installed at each of the compartments 42*a*, 42*b*, 42*c*, and 42*d* according to the properties of detergents to be held therein.

Alternatively, the first and second compartments 42*a* and 42*b* may be adapted to hold the powdered detergent used for main washing and rough washing, and the third and fourth compartments 42*c* and 42*d* be adapted to hold the bleaching agent and the fabric softener, respectively. The first and second compartments 42*a* and 42*b* can have any structure as long as the top is opened to let the powdered detergent 2 and water in from above and the rear is opened to allow the powdered detergent 2 and water to enter into the dispenser housing 53; whereas the third and fourth compartments 42*c* and 42*d* may be formed at positions which are spaced apart upward from the ground by a predetermined height, and have a box shape whose top is open to let the bleaching agent and the fabric softener. Also, a detergent box cap (auxiliary receiving platform; not shown) for sealing may be additionally installed on the top surface of the third and fourth compartments 42*c* and 42*d*. Preferably, the detergent box cap is provided with an entrance (not shown) for putting the bleaching agent and the fabric softener in.

A siphon tube 43 may be protruded upward from each of the compartments 42*a*, 42*b*, 42*c*, and 42*d* to dissolve the respective detergents and discharge them through the incoming water supply pipes 32 or the outgoing water supply pipe 33 when water from the water supply mechanism 30 is filled up. That is, because a liquid bleaching agent and a fabric softener are put into the third and fourth compartments 42*c* and 42*d*, the third and fourth compartments 42*c* and 42*d* and the detergent box cap each have a siphon device for discharging liquids, such as the bleaching agent and the fabric softener, according to the siphon principle.

The siphon device may further include a siphon tube 43 protruding upward from the bottom surfaces of the third and fourth compartments 42*c* and 42*d* so as to communicate with the underside space of the third and fourth compartments 42*c* and 42*d* and a siphon cap (not shown) protruding downward from a bottom of the detergent box cap to allow the siphon tube 43 to be inserted therein. The outer diameter of the siphon tube 43 is smaller than the inner diameter of the siphon cap, and therefore a discharge passage of the bleaching agent and the fabric softener may be formed between the siphon tube 43 and the siphon cap.

As suggested in the present invention, the detergent box 40 of this type may include a structure of a new type of partitioning member 44 which allows the user to arbitrarily choose and put a liquid or powdered detergent 1 or 2 in one compartment 42*a* of the detergent-holding unit 42.

That is, as can be seen from various embodiments shown in FIGS. 7 and 8, the partitioning member 44 is vertically divided into an upper fixed partition 45 and a lower, rotatable opening and closing partition 46 coupled to the lower end of the upper fixed partition 45 depending on the physical properties of detergents in granulated or liquid form. Thus, the user is able to selectively perform the simple operation of opening a lower part of the partitioning member 44 by folding the lower opening and closing partition 46 in an upward direction; or closing the lower part of the partitioning member 44 by unfolding the folded lower opening and closing partition 46 in a downward direction. By doing so, the detergent box 40 provides the convenience of containing not only the powdered detergent 2 mainly used conventionally when the partition is partially opened, but also containing and using the liquid detergent 1 without installing a separate auxiliary receiving platform for liquid detergents inside the detergent box 40 when the partitioning member 44 is fully closed.

Additionally, as shown in FIGS. 5 and 6, the partitioning member 44 of the invention realizes a structure where the compartment 42*a* of the detergent box body 41 is closed to contain the liquid detergent 1 when the liquid detergent 1 is put therein, and opened to let in water when the powdered detergent 2 is put therein. The partitioning member 44 includes the upper fixed partition 45 and the lower opening and closing partition 46 which is connected to a lower part of the upper fixed partition 45 and opens and closes an opening 44*a* (see FIG. 6) of the compartment 42*a* by being folded upward and unfolded downward around the connecting portion.

As shown in FIGS. 5 to 7, the connecting portion between the upper fixed partition 45 and the lower opening and closing partition 46 is formed as a folding groove 47 for folding the lower opening and closing partition 46 upward and unfolding it downward, thereby realizing a structure where the upper fixed partition 45 and the lower opening and closing partition 46 are integrated together.

Alternatively, as shown in FIG. 8, the connecting portion between the upper fixed partition 45 and the lower opening and closing partition 46 connects two separate panels, divided into the upper fixed partition 45 and the lower opening and closing partition 46, by a hinge pin 48, thereby realizing a hinge structure that enables the lower opening and closing partition 46 to be folded from the upper fixed partition 45.

The above-described structure of the partitioning member 44 according to two embodiments of the present invention as shown in FIGS. 7 and 8 may be configured such that, when the lower opening and closing partition 46 is folded, the folded state is held by inserting and coupling a fixing protrusion 46*a* into a fixing hole 45*a*, the fixing hole 45 being formed on any one of the surfaces brought into contact when the upper fixed partition 45 and the lower opening and closing partition 46 are folded, and the fixing protrusion 46*a* being formed on the corresponding contacting surface. This is only an example of fixing means of the lower opening and closing partition 46 and is not necessarily limited thereto, but any structure is possible as long as it performs the same function.

The operation of the thus-constructed washing machine according to a preferred embodiment of the present invention will be described below with reference to FIG. 2.

First, laundry is put into the drum 22 via a laundry entrance 22, and the laundry entrance 22*c* is enclosed with the door 16 and then the washing machine is operated. At this time, the washing machine senses the volume of the laundry put in the drum 22, and sets water level, supply amount of detergent, washing time, and so on.

Then, the water supply mechanism 30 is operated to supply water into a tub 21 until a set water level is reached. In other words, when the water supply control valves 31 of the water supply mechanism 30 are opened, water is introduced from an external water source via the water supply control valves 31, and the water is supplied into the tub 21 along the incoming water supply pipes 32, the detergent supply mechanism D, and the outgoing water supply pipe 33.

At this point, if a detergent has been put in the detergent-holding unit 42 of the detergent box 40, the detergent in the detergent-holding unit 42 is supplied, together with the water supplied from the water supply mechanism 30, into the tub 21.

On the other hand, if no detergent has been put in the detergent-holding unit 42 of the detergent box 40, the separate liquid detergent supply mechanism 60 is operated to supply a liquid detergent into the tub 21 until a set supply amount is reached. That is, when the liquid detergent supply pump 62 of the liquid detergent supply mechanism 60 is operated, the liquid detergent 1 stored in the liquid detergent storage unit 61 is pumped by the liquid detergent supply pump 62, and the liquid detergent 1 flows into the tub 22 along the liquid detergent supply pipe 63.

Once the supply of water and detergent into the tub 21 is finished, the driving mechanism (motor) 23 is operated to rotate the drum 22 for a set period of time. Thus, the laundry in the drum 22 is lifted upward and then dropped downward by the rotation of the drum 22 and the lifter 2*b*, thereby performing washing.

Once the washing stroke for the laundry is finished, the operation of the driving mechanism 23 is stopped, and then the draining mechanism 70 is operated to drain out the water used for the washing in the tub 21. Next, the water supply mechanism 30 is operated to re-supply water until a set water level is reached, and the driving mechanism 23 is operated to re-rotate the drum 22, thereby performing the rinsing of the laundry.

Once the rinsing stroke for the laundry is finished, the operation of the driving mechanism 23 is stopped, and then the draining mechanism 70 is operated to drain out the water used for the rinsing in the tub 21. Then, when the water is completely drained out of the tub 21, the driving mechanism 23 is operated again to rotate the drum 22 at a high speed, and thereafter the operation of the washing machine is stopped. Once the drum 22 is rotated at a high speed, the water contained in the laundry is discharged to the outside of the drum 22, and the water collected in the tub 21 is drained out by the drainage mechanism 70.

In the overall washing process, the step of causing water to flow in the detergent supply mechanism D during operation of the water supply mechanism 30 and the step of supplying water and detergent to the tub 21 will be described more concretely based on FIGS. 3 to 6.

When the detergent box 40 is completely inserted in the dispenser 50, as shown in FIGS. 3 and 4, water enters the dispenser body 51 through the water supply control valves 31 and the incoming water supply pipes 32, and the water is sprayed into the detergent-holding unit 42 of the detergent box 40 through the nozzles 51*c* of the dispenser body 51. Also, the water sprayed into the detergent-holding unit 42 flows rearward along the bottom surface of the detergent-holding unit 42, and thereafter discharged to the rear space portion 53*c* of the dispenser housing 53. The water stored in the rear space portion 53*c* enters the outgoing water supply pipe 33 through the liquid detergent outlet 53*e*, and supplied into the tub 21 through the outgoing water supply pipe 33.

Accordingly, if an appropriate amount of powdered detergent 2 has been put into the detergent-holding unit 42 before the water supply mechanism 30 is operated, the powdered detergent 2 is dissolved in the water sprayed into the detergent-holding unit 42, and the water and the detergent flow along the rear space portion 53*c* and the outgoing water supply pipe 33 and supplied into the tub 21.

Once the detergent box 40 has been inserted in the dispenser 50, even if the water from the water supply mechanism 30 is supplied to any one of the compartments of the detergent-holding unit 42, including the first and second compartments 42*a* and 42*b* for the powdered detergent 2, the third compartment 42*c* for bleaching agent, and the fourth compartment 42*d* for fabric softener, the respective detergents held in the detergent-holding unit 42 and the water supplied from the water supply mechanism 30 flow to the tub 21 along the rear space portion 53*c* and the outgoing water supply pipe 33.

Moreover, the present invention offers the advantage that the same compartment 42*a* of the detergent-holding unit 42 can hold either the liquid detergent 1 or the powdered detergent 2. In other words, the liquid detergent 1 can be put in the compartment 42*a* as shown in FIG. 5 as long as there is provided an enclosed structure where the opening 44*a* at a lower part of the partitioning member 44 is enclosed by downwardly unfolding the lower opening and closing partition 46 of the partitioning member 44 constituting the compartment 42*a*, thus preventing leakage of the liquid detergent 1. At this point, the passage between the partitioning members 44 of the adjacent compartments 42*a* and 42*c* may function as a siphon tube 43.

Also, the powdered detergent 2 can be put in the compartment 42*a* as shown in FIG. 6 as long as there is provided an opened structure where the opening 44*a* at the lower part of the partitioning member 44 is opened by upwardly folding the lower opening and closing partition 46 around the folding groove 47 formed between the upper fixed partition 45 and the lower opening and closing partition 46, thus introducing water through the opening 44*a*. At this point, the opened state can be maintained by fitting the fixing protrusion 46*a* formed on the lower opening and closing partition 46 into the fixing hole 45*a* formed in the fixed partition 45.

In the case that the liquid detergent supply mechanism 60 and the liquid detergent storage unit 61 are provided inside the washing machine, a liquid detergent may be supplied into the tub 21 from the liquid detergent supply mechanism 60 and the liquid detergent storage unit 61 as shown in FIG. 2. The step of supplying a liquid detergent from this equipment will be described below in detail.

The detergent box 40 is drawn out to put detergent in the detergent-holding unit 42, and then received inside the dispenser 50. The detergent enters the front space portion 53*b* of the dispenser housing 53, and the detergent stored in the front space portion 53*b* is discharged along the liquid detergent supply connection pipe 64 through the liquid detergent supply opening 53*d* formed in the front space portion 53*b* and stored inside the liquid detergent storage unit 61.

Accordingly, when a liquid or powdered detergent 1 or 2 is put in the detergent-holding unit 42 of the detergent box 40, rather than directly putting the liquid detergent 1 in the liquid detergent storage unit 61, the liquid detergent can be reserved in the liquid detergent storage unit 61. Moreover, the detergent box 40 can be used for the supply of water, the supply of the liquid or powdered detergent 1 or 2, and the storage of the liquid detergent, thus enhancing the utilization of the part.

Figure 9:
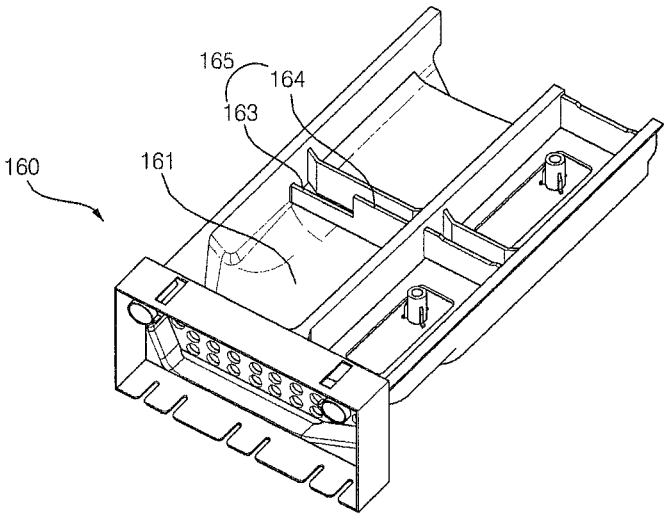
FIG. 9 is a perspective view illustrating another embodiment of a detergent box of FIG. 2.
Figure 10:
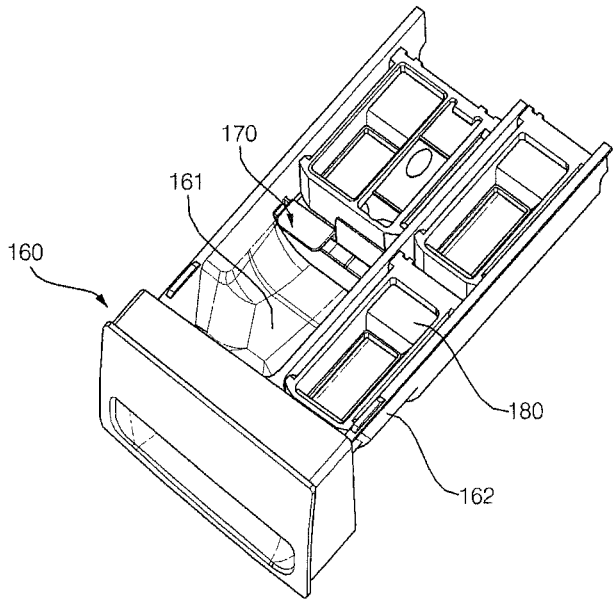
FIG. 10 is a perspective view illustrating one embodiment for fastening a partitioning member to the detergent box of FIG. 9.
Figure 11:
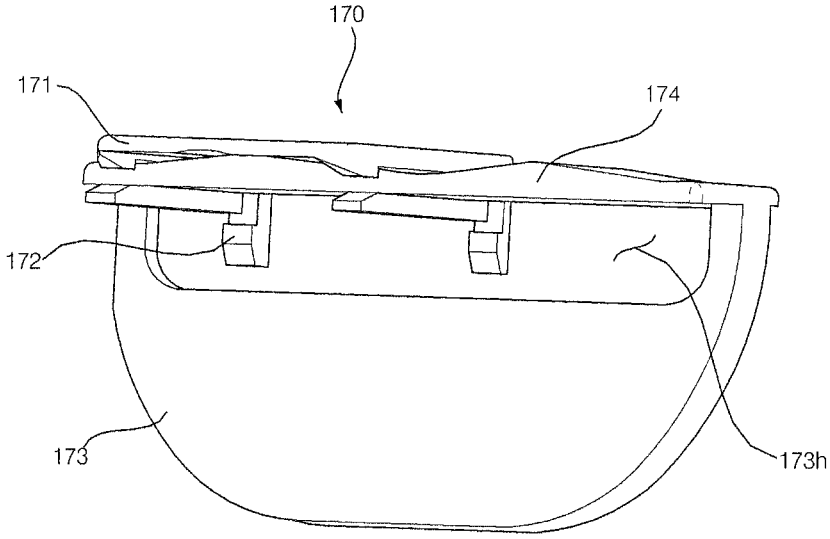
FIG. 11 is a perspective view illustrating one embodiment of the partitioning member of FIG. 10.

FIG. 9 is a perspective view illustrating another embodiment of a detergent box of FIG. 1. FIG. 10 is a perspective view illustrating one embodiment for fastening a partitioning member 170 to a detergent box 160 of FIG. 9. FIG. 11 is a perspective view illustrating the partitioning member 170 of FIG. 10.

Referring to FIGS. 9 to 11, the detergent box 160 includes a detergent-holding unit 161 for holding liquid detergent or powdered detergent, guides 165 formed at the detergent box 160 and having different heights, and an additive-holding unit 162 for holding additives such as fabric softener or bleaching agent.

The guides 165 are spaced apart from the bottom surface of the detergent-holding unit 161. Also, the guides 165 include a first guide 163 for engaging the partitioning member 170 when a liquid detergent is stored in the detergent-holding unit 161 and a second guide 164 having a different height from the height of the first guide 163, and for engaging the partitioning member 170 when a powdered detergent is contained in the detergent-holding unit 161. The height of the first guide 163 is smaller than the height of the second guide 164.

The partitioning member 170 includes a stopping member 171 for engaging the guides 165 and a body portion 173 for slidably engaging the stopping member and opening and closing the gap between the guides 165 and the bottom surface of the detergent-holding unit 161.

The stopping member 171 slides along the body portion 173 to be engaged with the first guide 163 or the second guide 164. When the stopping member 171 is engaged with the first guide 163, the body portion 173 closes the gap between the guides 165 and the detergent-holding unit 161, and when the stopping member 171 is engaged with the second guide 164, the body portion 173 opens the gap between the guides 165 and the detergent-holding unit 161. Therefore, the position of the stopping member 171 may be changed depending on whether the detergent contained in the detergent-holding unit 161 is liquid or powder, so that the stopping member 171 can be engaged with the first guide 163 or the second guide 164. The flow of washing water when liquid detergent and powdered detergent are stored in the detergent-holding unit will be described later.

Figure 12:
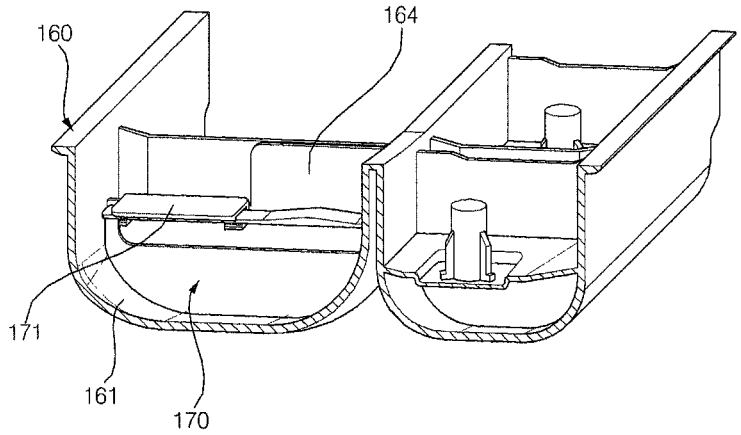
FIG. 12 is a partial perspective view illustrating the fastening of the partitioning member to the detergent box when a liquid detergent is stored in the detergent box of FIG. 9.
Figure 13:
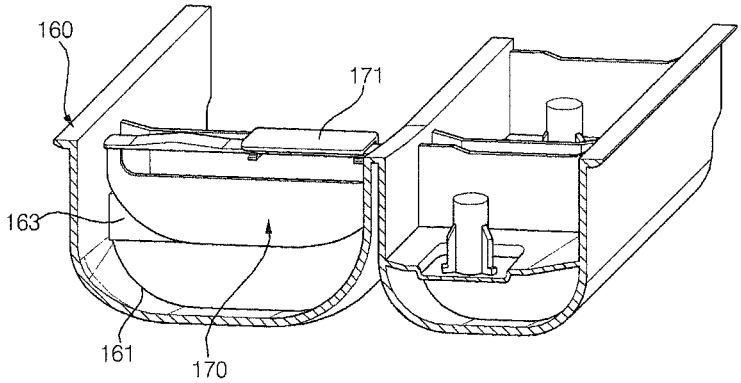
FIG. 13 is a partial perspective view illustrating the fastening of the partitioning member to the detergent box when a powdered detergent is stored in the detergent box of FIG. 9.

The body portion 173 is formed with a stopping member guide 174 that is curved and slidably engages the stopping member 171. As shown in FIG. 12, the stopping member 171 is engaged with the first guide 163, being moved to one side along the stopping member guide 174, and, as shown in FIG. 13, the stopping member 171 is engaged with the second guide 164, being moved to the other side along the stopping member guide 174.

After the position of the stopping member 171 is set by the user when the stopping member 171 is removed from the guides 165, the stopping member guide 174 is curved so as to prevent the stopping member 171 from moving from the set position. As the stopping member 171 has to be fixed at a first position (shown in FIG. 12) corresponding to when engaged with the first guide 163 or at a second position (shown in FIG. 13) corresponding to when engaged with the second guide 164, the stopping member guide 174 is curved twice so as to corresponding to the first position and the second position, respectively.

Moreover, the stopping member 171 is elastically moved to the first or second position due to the curvature, thereby improving operational feeling and user convenience when setting the position of the stopping member 171.

The stopping member 171 may be disposed at different positions by being slid along the stopping member guide 174 formed above the body portion 173 depending on which of liquid and powdered detergents the user wants to put in the detergent-holding unit 161.

Further, the stopping member guide 174 may include an elastic member for fixing the position of the stopping member 171 by elastic force. The elastic member may include a first plate spring corresponding to the first position and a second plate spring corresponding to the second position in order to fix the stopping member 171 at the first or second position.

If the stopping member 171 is set to the first position, the first plate spring is deformed, and the stopping member guide 174 and the stopping member 171 are closely attached to each other by the elastic force generated on this occasion to thus fix the position of the stopping member 171. Likewise, if the stopping member 171 is set to the second position, the second plate spring is deformed, and the stopping member guide 174 and the stopping member 171 are closely attached to each other by the elastic force generated on this occasion to thus fix the position of the stopping member 171.

FIG. 12 is a partial perspective view illustrating the fastening of the partitioning member 170 to the detergent box 160 when a liquid detergent is stored in the detergent-holding unit 161 of FIG. 9. FIG. 13 is a partial perspective view illustrating the fastening of the partitioning member 170 to the detergent box 160 when a powdered detergent is stored in the detergent-holding unit 161 of FIG. 9

Hereinafter, a method of operating the partitioning member 170 depending on whether the detergent put into the detergent-holding unit 161 is liquid or powder will be described with reference to FIGS. 12 and 13.

When putting a liquid detergent in the detergent-holding unit 161, the user pulls out the detergent box 160 to close the gap between the guides 165 and the bottom surface of the detergent-holding unit 161 by the partitioning member 170. To this end, the user slides the stopping member 171 along the stopping member guide 174 to be placed at the first position (position of the stopping member 171 shown in FIG. 12). An engaging portion 172 is engaged with the first guide 163, with the stopping member 171 being placed at the first position. As such, the gap between the guides 165 and the bottom surface of the detergent-holding unit 161 is closed by the body portion 173.

Afterwards, a liquid detergent is put into the detergent-holding unit 161, and the detergent box 160 is pushed again into the washing machine along the detergent box receiving space 15.

Thereafter, the operation of the washing machine is started, and once water supply is performed by the water supply mechanism 30, washing water is supplied to the detergent box 160. The washing water supplied to the detergent-holding unit 161 is mixed with the liquid detergent. As the supply of the washing water continues, the water level becomes higher and higher. When a predetermined water level is reached, the washing water flows through a hole 173*h* formed in the body portion 173 and is supplied into the washing tub 20.

Meanwhile, when putting a powdered detergent in the detergent-holding unit 161, the user pulls out the detergent box 160 to open the gap between the guides 165 and the bottom surface of the detergent-holding unit 161 by the partitioning member 170. To this end, the user slides the stopping member 171 along the stopping member guide 174 to be placed at the second position (position of the stopping member 171 shown in FIG. 13). The engaging portion 172 is engaged with the second guide 164, with the stopping member 171 being placed at the second position. As such, the gap between the guides 165 and the bottom surface of the detergent-holding unit 161 is opened by the body portion 173.

Afterwards, a powder detergent is put into the detergent-holding unit 161, and the detergent box 160 is pushed again into the washing machine along the detergent box receiving space 15.

Thereafter, the operation of the washing machine is started, and once water supply is performed by the water supply mechanism 30, washing water is supplied to the detergent box 160. The washing water supplied to the detergent-holding unit 161 is mixed with the powdered detergent and flows along the gap between the guides 165 and the bottom surface of the detergent-holding unit 161, and is supplied into the washing tub 20.

Accordingly, as discussed above, the user is able to easily put a liquid detergent by means of the partitioning member 170 without engaging a separate container for liquid detergent with the detergent box 160. Moreover, it is possible to selectively use liquid detergent or solid detergent by forming the first guide 163 and the second guide 164 with different heights and performing the simple operation of engaging the stopping member 171 with the first guide 163 or the second guide 164 depending on whether the detergent to be put in is liquid or powder, thus offering the advantage of not having to provide a separate liquid detergent supply unit.

Further, the partitioning member 170 is kept mounted to the detergent box 160 all the time regardless of whether the detergent to be put is liquid or powder, thereby eliminating the problem of frequent losses of a separate container conventionally provided for the supply of liquid detergent.

Figure 14:
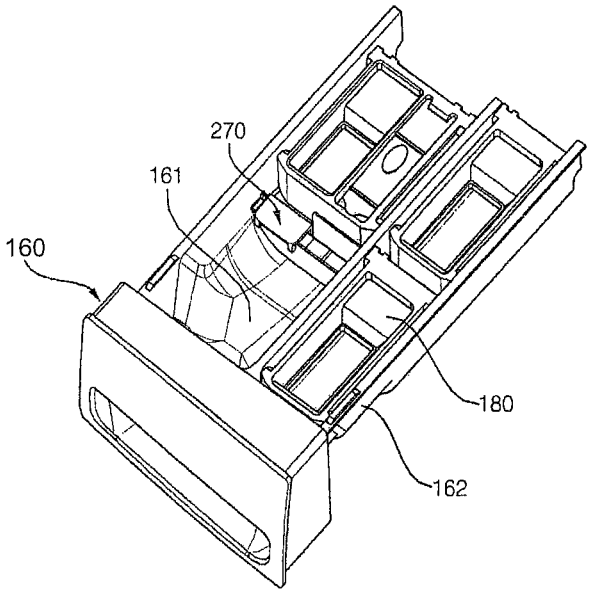
FIG. 14 is a perspective view illustrating the fastening of a partitioning member to a detergent box according to another embodiment applied to the washing machine of the present invention.
Figure 15:
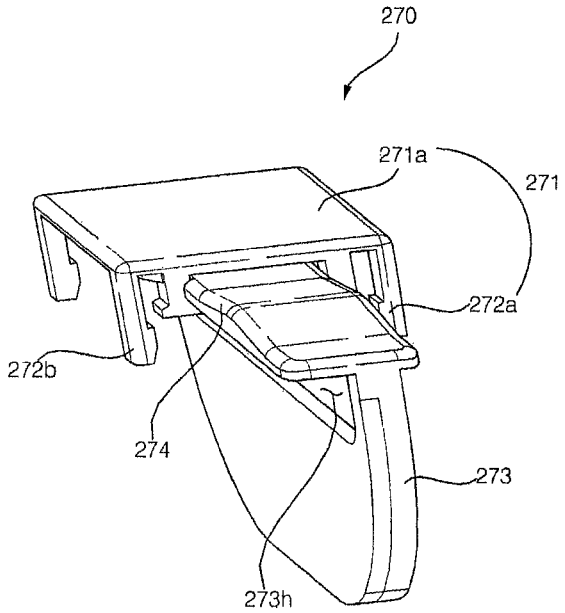
FIG. 15 is a perspective view illustrating the partitioning member of FIG. 14.

FIG. 14 is a perspective view illustrating the fastening of a partitioning member 270 to a detergent box 160 according to another embodiment applied to the washing machine of the present invention. FIG. 15 is a perspective view illustrating the partitioning member 270 of FIG. 14;

Referring to FIGS. 14 and 15, the detergent box 160 includes a detergent-holding unit 161 for holding liquid detergent or powder detergent, guides 165 formed at the detergent box 160 and having different heights 165, and an additive-holding unit 162 for holding additives such as fabric softener or bleaching agent.

The guides 165 are spaced apart from the bottom surface of the detergent-holding unit 161. Also, the guides 165 include a first guide 163 for engaging the partitioning member 270 when a liquid detergent is stored in the detergent-holding unit 161 and a second guide 164 having a different height from the height of the first guide 163, and for engaging the partitioning member 270 when a powdered detergent is contained in the detergent-holding unit 161. The height of the first guide 163 is smaller than the height of the second guide 164.

The partitioning member 270 includes a stopping member 271 for engaging the guides 165 and a body portion 273 for slidably engaging the stopping member and opening and closing the gap between the guides 165 and the bottom surface of the detergent-holding unit 161.

The stopping member 271 includes a sliding portion 271*a* that slides along the body portion 273 and engaging portions 272*a* and 272*b* that are formed at both sides of the sliding portion 271*a* and engaged with the guides 165.

The stopping member 271 slides along the body portion 273 to be engaged with the first guide 163 or the second guide 164. When the stopping member 271 is engaged with the first guide 163, the body portion 273 closes the gap between the guides 165 and the detergent-holding unit 161, and when the stopping member 271 is engaged with the second guide 164, the body portion 273 opens the gap between the guides 165 and the detergent-holding unit 161. Therefore, the position of the stopping member 271 may be changed depending on whether the detergent contained in the detergent-holding unit 161 is liquid or powder, so that the stopping member 271 can be engaged with the first guide 163 or the second guide 164. The flow of washing water when liquid detergent and powdered detergent are stored in the detergent-holding unit will be described later.

Figure 16:
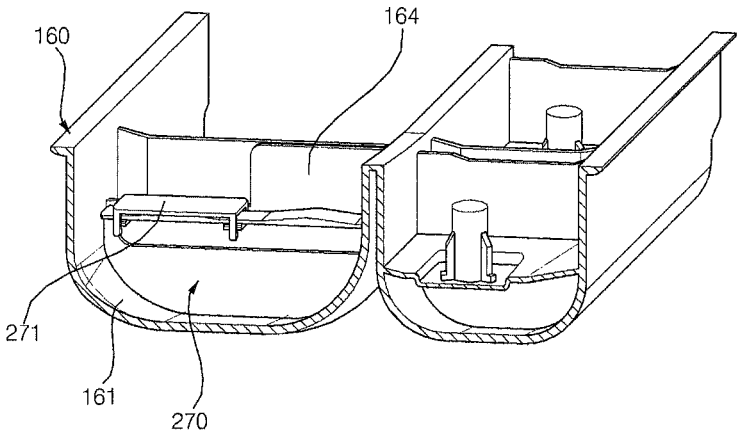
FIG. 16 is a partial perspective view illustrating the fastening of a partitioning member to a detergent box when a liquid detergent is stored in a detergent-holding unit.
Figure 17:
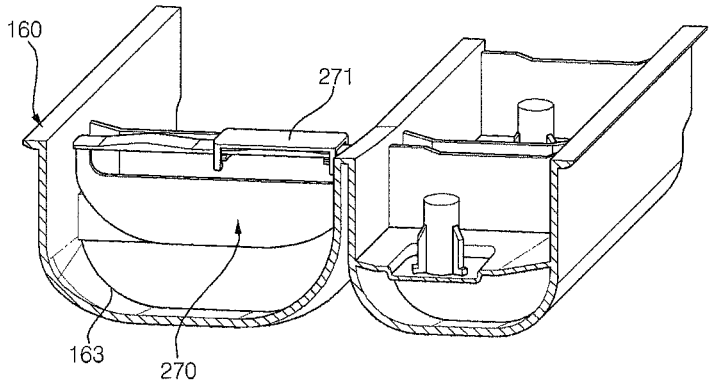
FIG. 17 is a partial perspective view illustrating the fastening of a partitioning member to a detergent box when a powdered detergent is stored in a detergent-holding unit.

The body portion 273 is formed with a stopping member guide 274 that is curved and slidably engages the stopping member 271. As shown in FIG. 16, the stopping member 271 engages with the first guide 163, being moved to one side along the stopping member guide 274, and, as shown in FIG. 17, the stopping member 271 is engaged with the second guide 164, being moved to the other side along the stopping member guide 274.

After the position of the stopping member 271 is set by the user when the stopping member 271 is removed from the guides 165, the stopping member guide 274 is curved so as to prevent the stopping member 271 from moving from the set position. As the stopping member 271 has to be fixed at a first position (shown in FIG. 16) corresponding to when engaged with the first guide 163 or at a second position (shown in FIG. 17) corresponding to when engaged with the second guide 164, the stopping member guide 274 is curved twice so as to corresponding to the first position and the second position, respectively.

Moreover, the stopping member 271 is elastically moved to the first or second position due to the curvature, thereby improving operational feeling and user convenience when setting the position of the stopping member 271.

The stopping member 271 may be disposed at different positions by being slid along the stopping member guide 274 formed above the body portion 273 depending on which of liquid and powdered detergents the user wants to put in the detergent-holding unit 161.

Further, the stopping member guide 274 may include an elastic member for fixing the position of the stopping member 271 by elastic force. The elastic member may include a first plate spring corresponding to the first position and a second plate spring corresponding to the second position in order to fix the stopping member 271 at the first or second position.

If the stopping member 271 is set to the first position, the first plate spring is deformed, and the stopping member guide 274 and the stopping member 271 are closely attached to each other by the elastic force generated on this occasion to thus fix the position of the stopping member 271. Likewise, if the stopping member 271 is set to the second position, the second plate spring is deformed, and the stopping member guide 274 and the stopping member 271 are closely attached to each other by the elastic force generated on this occasion to thus fix the position of the stopping member 271.

FIG. 16 is a partial perspective view illustrating the fastening of the partitioning member 270 to the detergent box 160 when a liquid detergent is stored in the detergent-holding unit 161. FIG. 17 is a partial perspective view illustrating the fastening of the partitioning member 270 to the detergent box 160 when a powdered detergent is stored in the detergent-holding unit 161.

Hereinafter, a method of operating the partitioning member 270 depending on whether the detergent put into the detergent-holding unit 161 is liquid or powder will be described with reference to FIGS. 16 and 17.

When putting a liquid detergent in the detergent-holding unit 161, the user pulls out the detergent box 160 to close the gap between the guides 165 and the bottom surface of the detergent-holding unit 161 by the partitioning member 270. To this end, the user slides the stopping member 271 along the stopping member guide 274 to be placed at the first position (position of the stopping member 271 shown in FIG. 16). An engaging portion 272*a* engages with the first guide 163, with the stopping member 271 being placed at the first position. As such, the gap between the guides 165 and the bottom surface of the detergent-holding unit 161 is closed by the body portion 273.

Afterwards, a liquid detergent is put into the detergent-holding unit 161, and the detergent box 160 is pushed again into the washing machine along the detergent box receiving space 15.

Thereafter, the operation of the washing machine is started, and once water supply is performed by the water supply mechanism 30, washing water is supplied to the detergent box 160. The washing water supplied to the detergent-holding unit 161 is mixed with the liquid detergent. As the supply of the washing water continues, the water level becomes higher and higher. When a predetermined water level is reached, the washing water flows through a hole 273*h* formed in the body portion 273 and is supplied into the washing tub 20.

Meanwhile, when putting a powdered detergent in the detergent-holding unit 161, the user pulls out the detergent box 160 to open the gap between the guides 165 and the bottom surface of the detergent-holding unit 161 by the partitioning member 270. To this end, the user slides the stopping member 271 along the stopping member guide 274 to be placed at the second position (position of the stopping member 271 shown in FIG. 17). The engaging portion 272*a* is engaged with the second guide 164, with the stopping member 271 being placed at the second position. As such, the gap between the guides 165 and the bottom surface of the detergent-holding unit 161 is opened by the body portion 273.

Afterwards, a powder detergent is put into the detergent-holding unit 161, and the detergent box 160 is pushed again into the washing machine along the detergent box receiving space 15.

Thereafter, the operation of the washing machine is started, and once water supply is performed by the water supply mechanism 30, washing water is supplied to the detergent box 160. The washing water supplied to the detergent-holding unit 161 is mixed with the powdered detergent and flows along the gap between the guides 165 and the bottom surface of the detergent-holding unit 161, and is supplied into the washing tub 20.

Contrary to the aforementioned sliding type operating method, a method of removing the partitioning member 270 engaged with the first guide 163 and then engaging it with the second guide 164 will be discussed. This method may also apply when the partitioning member 270 engaged with the second guide 164 is removed and engaged with the first guide 163.

The partitioning member 270 according to this embodiment has engaging portions 272*a* and 272*b* formed at both sides of the sliding portion 271*a*. Due to the above structure, the stopping member 271 may be engaged with the guides 165 by either the first engaging portion 272*a* or the second engaging portion 272*b*. In an example, the stopping member 271 engaged with the first guide 163 by the first engaging portion 272*a* can be engaged with the second guide 164 by the simple operation of removing the stopping member 271 from the first guide 163 and then engaging the second engaging portion 272*b* with the second guide 164.

Accordingly, it is not necessary for the stopping member 271 to have a structure that slides along the stopping member guide 274. Even when the stopping member 271 and the stopping member guide 274 are formed integral with each other, the gap between the guides 165 and the bottom surface of the detergent-holding unit 161 can be opened and closed according to the type of detergent, as in the previous embodiments, by selectively engaging the first engaging portion 272*a* or the second engaging portion 272*b* with the guides 165 depending on whether the type of detergent to be put in is liquid or powder.

The user is able to easily put a liquid detergent by means of the partitioning member 270 without engaging a separate container for liquid detergent with the detergent box 160. Moreover, it is possible to selectively use liquid detergent or solid detergent by forming the first guide 163 and the second guide 164 with different heights and performing the simple operation of engaging the stopping member 271 with the first guide 163 or the second guide 164 depending on whether the detergent to be put in is liquid or powder, thus offering the advantage of not having to provide a separate liquid detergent supply unit.

Further, the partitioning member 270 is kept mounted to the detergent box 160 all the time regardless of whether the detergent to be put is liquid or powder, thereby eliminating the problem of frequent losses of a separate container conventionally provided for the supply of liquid detergent.

Although the washing machine according to the present invention has been described with reference to the illustrated drawings, it will be apparent to those skilled in the art that the present invention is not intended to be limited to the above-described embodiment and drawings, and various changes or modifications may be made therein without departing from the scope and the technical spirit of the present invention. That is to say, the present invention is not limited to a drum type washing machine, but can be applied to a water jet washing machine, etc.

Further, in the present invention, a plurality of liquid detergent storage units may be provided depending on the type of liquid detergent used for washing, and a plurality of liquid detergent supply ports for putting liquid detergent in the liquid detergent storage units may be formed in the detergent box.

What is claimed is:

1. A washing machine comprising:

a detergent box which is provided in a withdrawable fashion on the water-supply flow pathway of the washing machine, and which is formed with a detergent-holding unit in such a way that it can hold detergent, the detergent box including a bottom surface and first and second lateral surfaces for the detergent-holding unit, the first and second lateral surfaces upwardly extended from the bottom surface;

a vertical guide connecting the first and second lateral surfaces, the guide being spaced apart from the bottom surface to form a gap between the guide and the bottom surface, the guide including a first vertical portion and a second vertical portion extending higher in a vertical direction than the first vertical portion; and a partitioning member which occludes the gap when engaged with the first vertical portion and opens the gap when engaged with the second vertical portion.

2. The washing machine of claim 1, wherein the partitioning member includes a horizontally slidable stopping member for engaging the first and second vertical portions, and a horizontal stopping member guide upon which the stopping member slides, wherein the gap is open when the stopping member is engaged with the second vertical portion and closed when the stopping member is engaged with the first vertical portion.

3. The washing machine of claim 2, wherein the stopping member guide has a curved surface along which the stopping member can slide.

4. The washing machine of claim 2, wherein the stopping member includes a sliding portion that slides along the stopping member guide, the sliding portion having a first side and a laterally opposite second side, and a plurality of engaging portions configured to engage with the first and second vertical portions, wherein the first side and the second side of the sliding portion are each provided with at least one engaging portion so that the partitioning member can engage the guide with the at least one engaging portion on the first side and be rotated so that the partitioning member can engage the guide with the at least one engaging portion on the second side.

* * * * *